US008447499B2

(12) United States Patent
Gentile et al.

(10) Patent No.: US 8,447,499 B2
(45) Date of Patent: May 21, 2013

(54) DIESEL ENGINE HAVING CAMS FOR CONTROLLING THE INTAKE VALVES, WHICH HAVE A MAIN LOBE AND AN ADDITIONAL LOBE RADIUSED TO EACH OTHER

(75) Inventors: Luca Gentile, Orbassano (IT); Francesco Vattaneo, Orbassano (IT)

(73) Assignee: C.R.F. Società Consortile per Azioni, Orbassano (Torino) (IT)

( * ) Notice: Subject to any disclaimer, the term of this patent is extended or adjusted under 35 U.S.C. 154(b) by 962 days.

(21) Appl. No.: 12/512,345

(22) Filed: Jul. 30, 2009

(65) Prior Publication Data

US 2010/0121558 A1 May 13, 2010

(30) Foreign Application Priority Data

Nov. 7, 2008 (EP) ..... 08425713

(51) Int. Cl.
*F01L 1/2637* (2006.01)
*F01L 1/08* (2006.01)
*F02M 25/0752* (2006.01)

(52) U.S. Cl.
USPC ..... 701/105; 701/108; 123/90.16; 123/90.6; 123/568.14

(58) Field of Classification Search
USPC ..... 123/90.6, 90.16, 90.17, 568.13, 568.14, 123/568.15, 568.17, 568.18, 280, 279, 278; 60/279; 701/105, 108
See application file for complete search history.

(56) References Cited

U.S. PATENT DOCUMENTS

| | | | | |
|---|---|---|---|---|
| 6,237,551 | B1 * | 5/2001 | Macor et al. | 123/90.15 |
| 7,201,121 | B2 * | 4/2007 | Weber et al. | 123/90.12 |
| 7,819,101 | B2 * | 10/2010 | Poola et al. | 123/90.6 |
| 2003/0111047 | A1 * | 6/2003 | Doria et al. | 123/432 |
| 2003/0164163 | A1 | 9/2003 | Lei et al. | |
| 2004/0065284 | A1 | 4/2004 | Wakeman | |

FOREIGN PATENT DOCUMENTS

| | | |
|---|---|---|
| DE | 10 2006 041231 | 3/2008 |
| EP | 0 961 870 | 12/1999 |
| EP | 1 273 770 | 1/2003 |
| EP | 1 589 213 B1 | 7/2006 |
| JP | A-2001-065320 | 3/2001 |

(Continued)

OTHER PUBLICATIONS

European Search Report for EP 08425713.8 dated Mar. 31, 2009.
English translation of Japanese Patent Office Action issued Oct. 30, 2012, in connection with Japanese Patent Application No. 2009-205943.

*Primary Examiner* — Stephen K Cronin
*Assistant Examiner* — Raza Najmuddin
(74) *Attorney, Agent, or Firm* — Nixon & Vanderhye, P.C.

(57) ABSTRACT

A supercharged diesel engine is equipped with an electronically controlled hydraulic system for variable actuation of the intake valves of the engine. The cam that controls each intake valve has an additional lobe for causing an additional opening of the intake valve, during the expansion and exhaust strokes, so as to provide an exhaust-gas recirculation directly inside the engine. The aforesaid additional lobe has its descending stretch radiused to the main lobe with a stretch corresponding to a non-zero lift of the valve in such a way that the profile of the lift of the valve has a portion corresponding to a substantially non-zero value of the lift that radiuses the descending stretch of the profile of the additional lift to the ascending stretch of the profile of the main lift.

3 Claims, 7 Drawing Sheets

FOREIGN PATENT DOCUMENTS

| | | |
|---|---|---|
| JP | A 2003-074386 | 3/2003 |
| JP | A-2008-157223 | 7/2008 |
| WO | WO 98/30787 | 7/1998 |
| WO | WO 2007/085944 | 8/2007 |

* cited by examiner

DIESEL ENGINE HAVING CAMS FOR CONTROLLING THE INTAKE VALVES, WHICH HAVE A MAIN LOBE AND AN ADDITIONAL LOBE RADIUSED TO EACH OTHER

This application claims priority to European Patent Application No. 08425713.8 filed 7 Nov. 2008, the entire contents of which is hereby incorporated by reference.

BACKGROUND OF THE INVENTION

The present invention relates to diesel engines of the type comprising:

- one or more cylinders and at least one intake valve for each cylinder, provided with elastic means that push the valve towards a closed position; and
- at least one camshaft for controlling the intake valves by means of respective tappets;
- wherein at least one intake valve for each cylinder is controlled by the respective tappet, against the action of the aforesaid elastic means, via hydraulic means including a pressurized fluid chamber;
- wherein the pressurized fluid chamber is designed to be connected, by means of a passage controlled by a solenoid valve, with an exhaust channel, so that, when said solenoid valve is open, the intake valve is uncoupled from the respective tappet and is kept closed by the aforesaid elastic means;
- there being associated to said engine electronic control means for controlling each solenoid valve in such a way as to vary the time and/or the stroke of opening of the respective intake valve as a function of the operating conditions of the engine.

Some time ago the present applicant developed a system for variable actuation of the intake valves of the engine, identified by the trademarks UNIAIR and MULTIAIR (see EP-A-803 642, EP-A-0 961 870, EP-A-0 931 912, EP-A-0 939 205, EP-A-1 091 097, EP-A-1 245 799, EP-A-1 243 763, EP-A-1 243 762, EP-A-1 243 764, EP-A-1 243 761, EP-A-1 273 770, EP-A-1 321 634, EP-A-1 338 764, EP-A-1 344 900, EP-A-1 635 045, EP-A-1 635 046, EP-A-1 653 057, EP-A-1 674 673, and EP-A-1 726 790).

FIG. 1 is a schematic illustration of the principle of operation of an electronically controlled hydraulic system for variable actuation of the intake valves of the engine, of the so-called UNIAIR or MULTIAIR type, which has been developed by the present applicant and has formed the subject of the various prior patents that have been indicated above. With reference to said figure, number 1 designates as a whole an intake valve associated to a respective intake duct 2 formed in a cylinder head 3 of an internal-combustion engine, specifically a diesel engine in the case of the present invention. The valve 1 is recalled towards its closed position (upwards as viewed in the figure) by a spring 4, whilst it is forced to open by a piston 5 acting on the top end of the stem of the valve. The piston 5 is in turn controlled by means of oil under pressure that is present in a pressurized chamber 6, acting on which is a pumping piston 7, which moves together with a tappet a that co-operates with a cam 9 of a camshaft 10. The tappet 8 is pushed by a spring 11 and is in sliding contact with the cam 9. The pressure chamber 6 is designed to be connected to an exhaust duct 12, which in turn communicates with an accumulator of pressurized oil 13, through a passage controlled by the open/close element 14 of a solenoid valve 15, which is in turn controlled by electronic control means, designated as a whole by E, as a function of the operating conditions of the engine. In the preferred embodiment of the aforesaid system, the solenoid valve 15 is of a normally open type. In said open condition, the chamber 6 is in communication with the discharge passage 12 so that the cam 9 is de-activated, since the movements of the tappet 8 and of the pumping piston 7 do not cause corresponding movements of the piston 5 for controlling the valve 1. Consequently, the latter remains in its closing position, in which it is held by the spring 4. When the solenoid valve 15 is closed, the chamber 6 is again pressurized, filling with oil coming from the passage 12 (which communicates with the circuit for lubrication of the engine) and from the accumulator 13, through an auxiliary passage controlled by a non-return valve 16, as well as through the passage of communication with the engine-lubrication circuit, controlled by the non-return valve 17. In said condition, the cam 9 is rendered active, in so far as the movements of the tappet 8 and of the pumping piston 7 are transmitted to the piston 5, which controls the movement of the valve 1. When the solenoid valve 15 is again brought into its open condition, the oil present in the chamber 6 is discharged, through the passage controlled by the solenoid valve 15, into the accumulator 13 so that the valve 1 closes rapidly on account of the spring 4, the cam 9 being thus rendered again inactive. The solenoid valve 15 is controlled by the electronic means E in the various operating conditions of the engine according to any pre-set strategy so as to vary as desired both the instant of opening of the intake valve and the instant of closing of the intake valve, as well as the opening stroke, so as to obtain an ideal operation of the engine, for example, from the standpoint of reduction of the consumption levels, or of reduction of noxious exhaust gases in the various operating conditions.

SUMMARY OF THE INVENTION

The present invention regards in particular a diesel engine of the type specified above in which the cam for controlling said intake valve with variable actuation has a main lobe for causing opening of the valve during the induction stroke for intake of fuel into the engine cylinder and an auxiliary lobe for causing an additional opening of the intake valve during the exhaust stroke. An engine of this type is described in EP 0 961 870 B1 and EP 1 273 770 B1 filed in the name of the present applicant. The additional opening of the intake valve during the exhaust stroke enables an exhaust-gas recirculation (EGR) inside the engine to be obtained, thanks to the fact that during the expansion and exhaust stroke part of the exhaust gases passes from the cylinder into the intake duct, through the open intake valve, and then returns into the cylinder during the subsequent induction stroke so as to participate in the subsequent combustion.

By providing a cam with an additional lobe, in order to obtain additional opening of the intake valve during the exhaust stroke, the system for variable actuation of the intake valves that has been described above enables control of operation of the engine in an optimal way. In fact, in the operating conditions of the engine in which the internal EGR is necessary, the solenoid valve associated to the intake valve remains in a closed condition so that the aforesaid pressurized chamber is full of oil, and the additional lobe of the cam is rendered active; i.e., it is able to cause effectively a corresponding lift of the intake valve during the exhaust stroke. In the operating conditions of the engine in which, instead, internal EGR is not desirable or is even harmful, the aforesaid solenoid valve is kept open so that the oil is discharged from the hydraulic chamber, and the additional lobe of the cam is rendered inactive so that the intake valve remains closed, since the movement of the tappet is not transmitted thereto. Of course, according to what is widely illustrated in the patents specified above, the system for variable actuation of the intake valves that has been developed by the present applicant enables the maximum flexibility and hence also enables any partial lift of the valve, with opening times and opening strokes that can also be varied as desired, both during the conventional induction cycle and when the additional lobe of the cam is active.

The adoption of a cam with an additional lobe for causing an additional lift of the intake valve during the expansion and exhaust strokes of the engine, can, however, lead to an inefficient operation of the system in given operating conditions of the engine. In particular, at cold starting of the engine (typically between −30° C. and −20° C.), the solenoid valves 15 are left open when the additional lobe is active, in so far as in said condition the internal EGR is not desirable, whereas they are closed to provide the normal lift of the valve during the induction stroke, when the main lobe of the cam is active. When the additional lobe is thus deactivated, the pumping piston 7 (see FIG. 1) is in any case displaced following upon engagement of the tappet 8 on the additional lobe, but said displacement is not transmitted to the intake valve 1. The displacement of the pumping piston 7 caused by the additional lobe hence determines in any case emptying of the chamber 6. When the tappet 8 arrives on the main lobe, the solenoid valve 15 is closed so as to cause again filling of the chamber 6 with pressurized oil. However, if between the end of the additional lobe and the start of the main lobe there is a small crank angle, the system might not have sufficient time to guarantee an adequate pressure in the chamber 6 before the tappet arrives on the main lobe of the cam.

The object underlying the present invention is to solve said problem in a simple and efficient way.

With a view to achieving the above purpose, the subject of the present invention is a diesel engine of the type that has been indicated at the start of the present description, i.e., one equipped with an electronically controlled hydraulic system for variable actuation of the intake valves and with cams for actuation of the intake valves, which comprise not only the main lobe, but also an additional lobe for causing an additional opening of the intake valves during the expansion and exhaust strokes in the various engine cylinders, said engine being moreover characterized in that the aforesaid additional lobe has its descending stretch radiused to the main lobe with a stretch corresponding to a non-zero lift of the valve, in such a way that the profile of the lift of the valve has a portion corresponding to a substantially non-zero value of the lift that radiuses the descending stretch of the profile of the additional lift to the ascending stretch of the profile of the main lift.

With said solution, the tappet and the corresponding pumping piston do not return into the end-of-travel position after engagement on the additional lobe of the cam, before engaging the main lobe. This is done so that the chamber G will be emptied of less oil (FIG. 1) in the aforesaid phases (typically upon cold starting at temperatures of between −30° C. and −15° C.), where the additional lobe is rendered inactive. In this way, the pressurized chamber 6 manages to remain full of oil at the moment when the solenoid valve is closed to cause opening of the intake valve during the normal induction stroke, notwithstanding the short time that elapses between descent of the tappet from the additional lobe and ascent of the tappet on the main lobe.

BRIEF DESCRIPTION OF THE DRAWINGS

Further characteristics and advantages of the invention will emerge from the ensuing description with reference to the annexed drawings, which are provided purely by way of non-limiting example and in which.

DETAILED DESCRIPTION OF THE INVENTION

Figure 2:
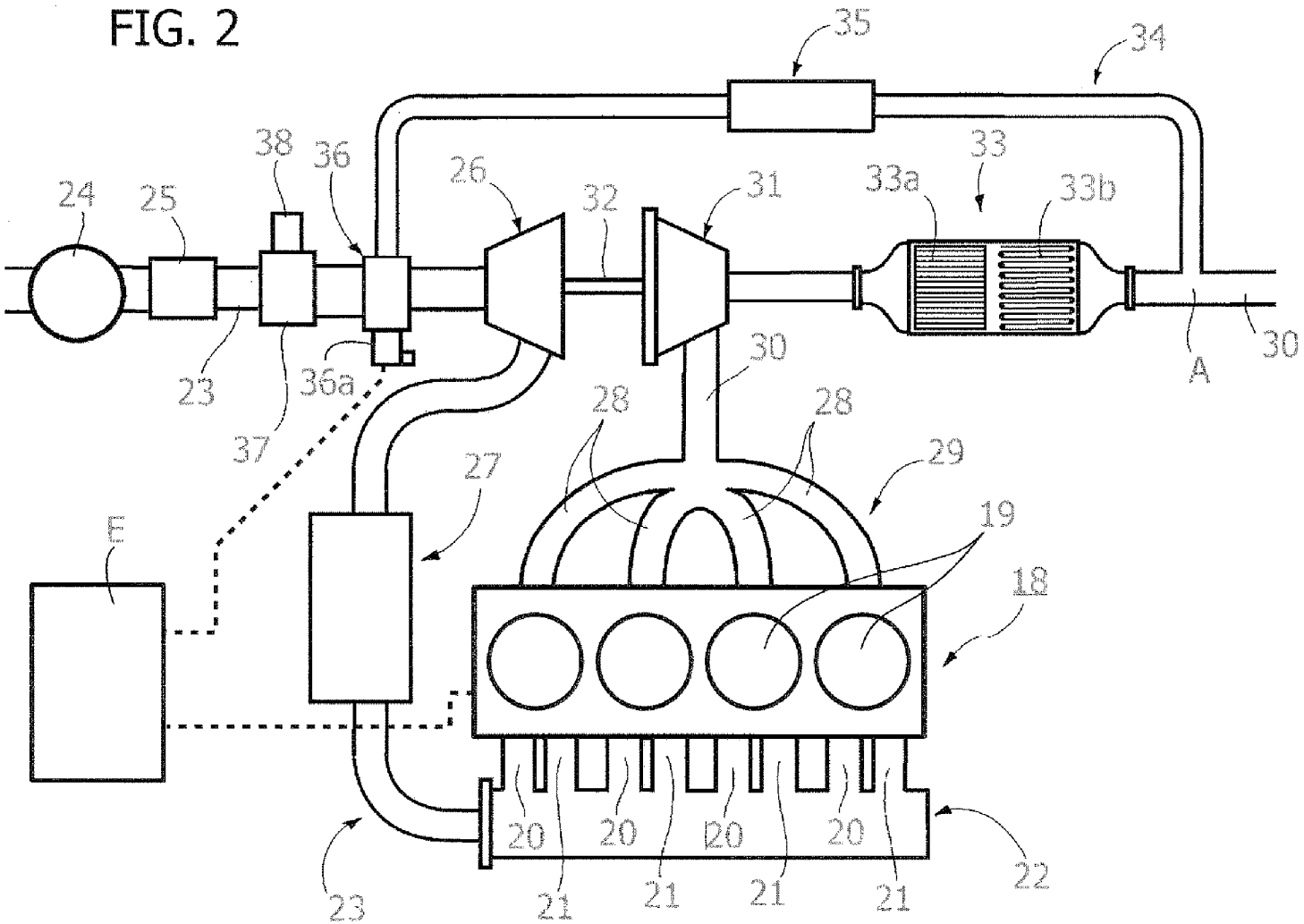
FIG. 2 is a schematic view exemplifying a diesel engine according to the invention, which, according to a technique in itself known, includes, in addition to the UNIAIR system of FIG. 1, also an external EGR system of the so-called "long-route" type, in which the exhaust gases that are made to recirculate in the engine are picked up at a point of the exhaust duct set downstream of the catalytic converter and of the particulate trap.

The present description specifically regards the application of a UNIAIR or MULTIAIR system of the type described above to a diesel engine, preferably a supercharged diesel engine, with external exhaust-gas recirculation (external EGR) of the so-called "long route" type. FIG. 2 of the annexed drawings is a schematic illustration of a preferred embodiment of the diesel engine according to the present invention. As already indicated above, the scheme of FIG. 2 is in itself of a known type. In particular, it has already been proposed by the present applicant (see EP-A-1 589 213) to apply the UNIAIR or MULTIAIR system described above to an engine with the scheme illustrated in FIG. 2. In said figure, the reference number 18 designates as a whole a diesel engine with four cylinders 19, each provided with two intake ducts 20, 21 controlled by respective intake valves (not illustrated) and forming part of an intake manifold 22 that receives air through a main intake duct 23. Set in series in the main intake duct 23 are an air filter 24, a debimeter 25, a compressor 26, and a cooling device or "intercooler" 27. As already indicated above, in the case of the engine according to the invention, in compliance with one of the proposals contained in EP-A-1 589 213, the intake valves of the engine are controlled by means of a variable-actuation system of the UNIAIR or MULTIAIR type that has been illustrated above.

With reference once again to FIG. 2, associated to each cylinder 19 of the engine is an exhaust duct 28, controlled by a respective exhaust valve (not illustrated) and forming part of an exhaust manifold 29 connected to a main exhaust duct 30. Set in series in the main exhaust duct 30 are a turbine 31, which actuates the compressor 26 via a drive shaft 32, and a device 33 for treatment of the exhaust gases, which comprises, set close to one another, a catalytic converter 33*a* and a particulate filter (trap) 33*b*. Once again according to what is envisaged in EP-A-1 589 213, a duct 34 for exhaust-gas recirculation (EGR) of the so-called "long-route EGR" or "low-pressure EGR" type branches off from the main exhaust duct 30, in a point A set downstream of the device 33 and converges in a point set upstream of the compressor 26, where a valve 36 for controlling the flowrate of the exhaust gases recirculated through the duct 34 is positioned. The valve 36 is controlled by an electric motor 36*a*, which is in turn controlled by electronic control means E constituted, for example, (but any alternative solution is possible) by the electronic control unit itself that also controls the solenoid valve of the UNIAIR system. The electronic means E are programmed for actuating the valve 36 according to a predetermined logic so as to vary according to said logic the amount of the exhaust gases recirculated in the various operating conditions of the engine.

Interposed in the exhaust-gas-recirculation duct 34 is a cooler 35. It is also possible to provide a by-pass duct in parallel with the cooler 35 and a valve that controls the distribution of the recirculated gases through the cooler 35 and through said by-pass duct.

Once again with reference to FIG. 2, in order to force the passage of large amounts of recirculated exhaust gases, a throttle valve 37, with a corresponding actuator device 38, is preferably provided, which is able to increase the pressure jump through the recirculation duct 34. Said device can be indifferently mounted on an intake duct, as illustrated in FIG. 2, upstream of the point of confluence of the recirculation duct 34, or else on the exhaust duct 30, in a point downstream of the area A where the gases to be recirculated are picked up. The preferred embodiment of the engine according to the invention envisages a scheme of the type illustrated in FIG. 2 in combination with a system of the type illustrated in FIG. 1, in which moreover the cams for controlling the intake valves of the engine present a profile shaped as illustrated in FIG. 3.

Figure 3:
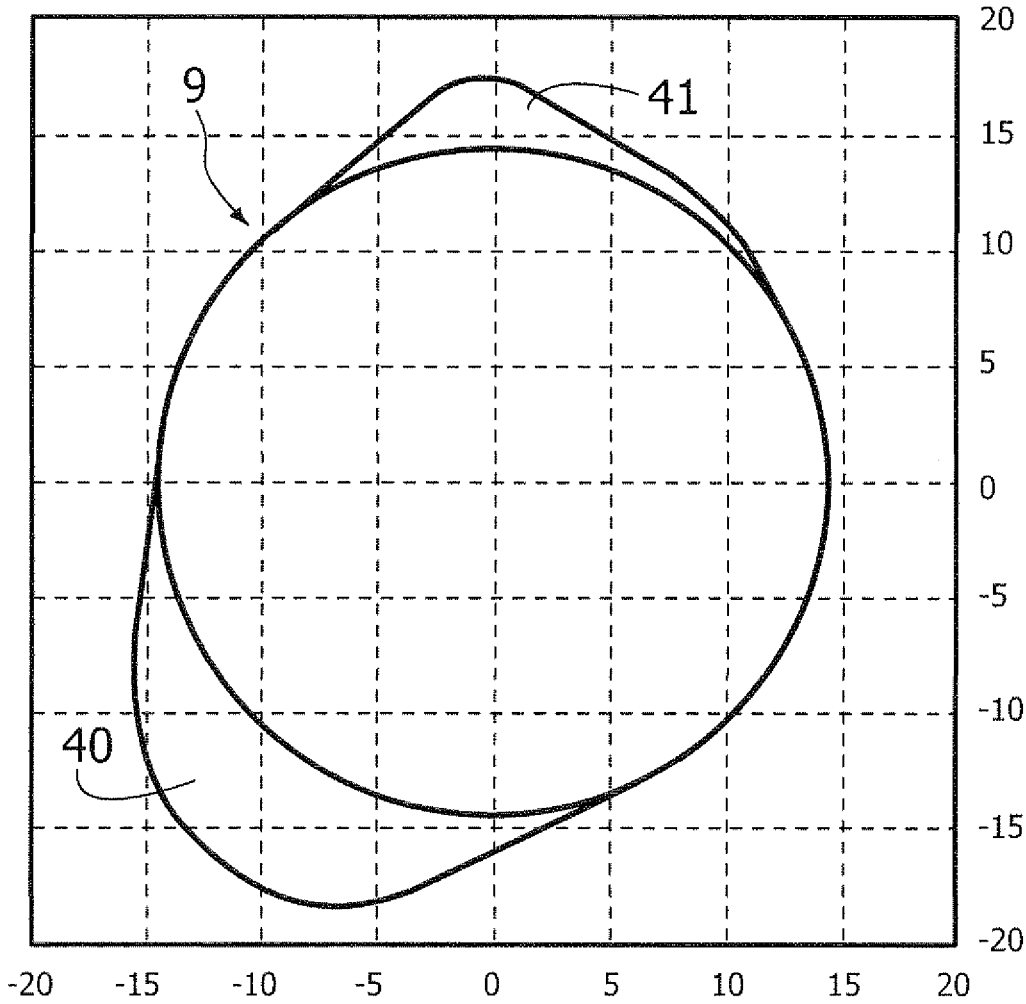
FIG. 3 is a schematic view of the cam for actuation of the intake valve associated to each engine cylinder according to an embodiment that does not form the subject of the present invention.
Figure 4:
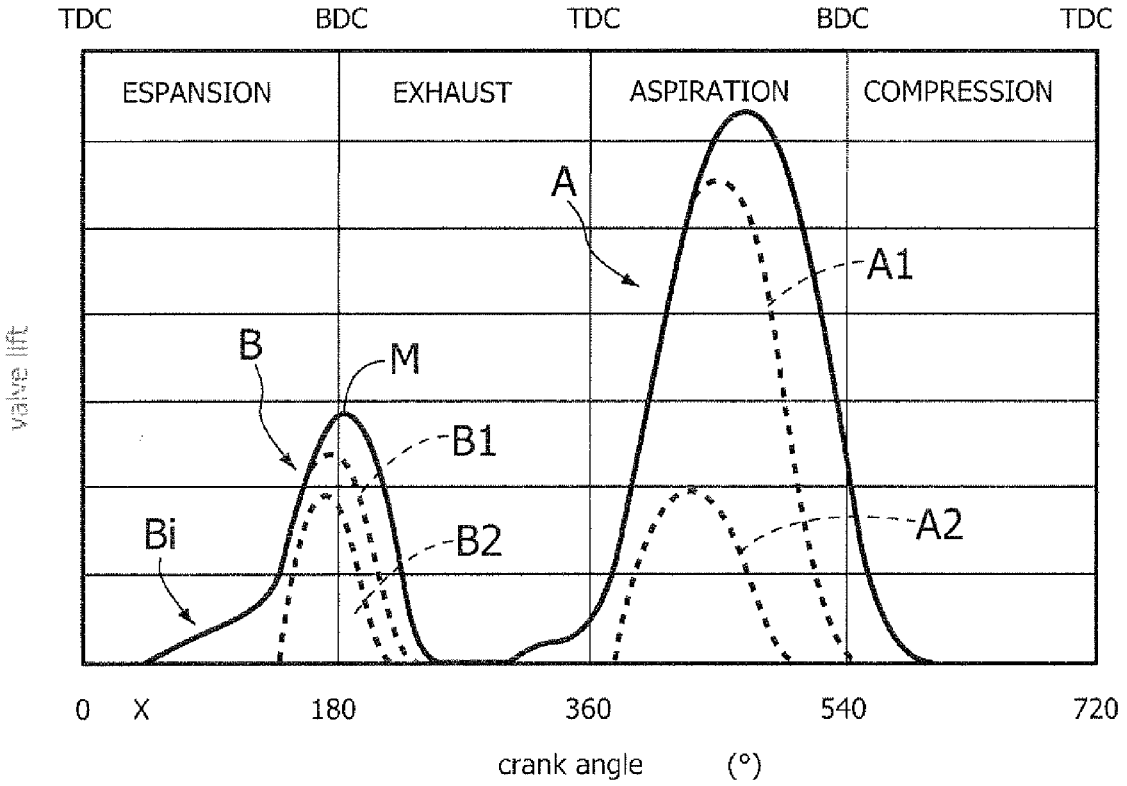
FIG. 4 illustrates a profile of the lift of the intake valve as a function of the crank angle, which can be obtained by means of the cam of FIG. 3.

FIGS. 3 and 4 illustrate an example of embodiment, which does not form the subject of the present invention, of a cam for controlling the intake valves in a diesel engine, and the corresponding profile of the lift of the intake valve as the crank angle varies.

As may be seen in FIG. 3 of the annexed drawings, each cam 9 for controlling the intake valves of the engine has both a main lobe 40, which determines the lift of the intake valve during the normal induction stroke for intake of fuel into the cylinder, and an auxiliary lobe, which determines an additional lift of the intake valve during the expansion and exhaust strokes in the cylinder, prior to the induction stroke. In the case of the example illustrated, which envisages two intake valves for each cylinder, each of said valves can be controlled by a respective cam of this type, but it is also possible to envisage that the teachings of the invention will be applied to just one of the two cams that control the intake valves of each cylinder.

Of course, both the main lobe 40 and the additional lobe 41 can be rendered inactive when the solenoid valve 15 (FIG. 1) associated to the intake valves of the engine are in the open condition. On the hypothesis that, instead, the solenoid valve is in a closed condition, each intake valve will present a diagram of valve lift of the type illustrated with a solid line in FIG. 4. Of course, the UNIAIR or MULTIAIR system of the present applicant is altogether flexible so that the solenoid valves 15 associated to the intake valves of the engine can be opened and closed at any moment to provide any intermediate condition. For example, the solenoid valves can be kept closed during the normal induction stroke of the engine so that the cam 9 for controlling each intake valve is completely active in said step, and the intake valve follows the main profile of complete lift designated by A in FIG. 4, whilst the solenoid valves 15 can be kept open when the additional lobe 41 of each cam 9 is in contact with the tappet so that the profile of additional lift, designated by B in the diagram, is not obtained, and the lift of the valve remains zero during said phase. Alternatively, both during the main profile A and during the additional profile B the solenoid valves can be initially closed, but then be opened to anticipate closing of the intake valve, according to the exemplifying lines designated by A1 and B1 in the diagram of FIG. 4. Or else again, for example, closing of the solenoid valves can be retarded and opening thereof can be anticipated with respect to the theoretical profile of lift of the valve so that each intake valve has a lift profile corresponding to the lines designated by A2 and B2 in the diagram of FIG. 4.

The provision of the additional lobe 41 on the cam 9 for controlling the intake valve has the purpose of enabling an exhaust-gas recirculation directly inside the engine. In fact, opening of the intake valve during the exhaust stroke in the engine causes part of the exhaust gases to converge in the intake duct so that in the subsequent induction stroke the part of exhaust gases that had previously converged into the intake duct returns into the combustion chamber to participate again in the subsequent combustion. The adoption of said solution in combination with a system for variable actuation of the valves of the type described of course makes it possible to prevent the intake valve from undergoing the aforesaid additional opening when the operating conditions of the engine are such that an EGR inside the engine is not necessary or is even counterproductive.

It should on the other hand be pointed out that the aforesaid solution, consisting in the combination of a cam having an additional lobe that causes an additional opening of the intake valve during the exhaust stroke with a system for variable actuation of the intake valves has already formed the subject of previous proposals filed in the name of the present applicant (EP-A-0 961 870 and EP-A-1 273 770). In addition, the creation of an internal ER by means of a UNIAIR or MULTIAIR system in a diesel engine moreover equipped with external ER of a long-route type has likewise formed the subject, as has already been indicated above, of a prior proposal filed in the name of the present applicant (EP-A-1 589 213).

Figure 6:
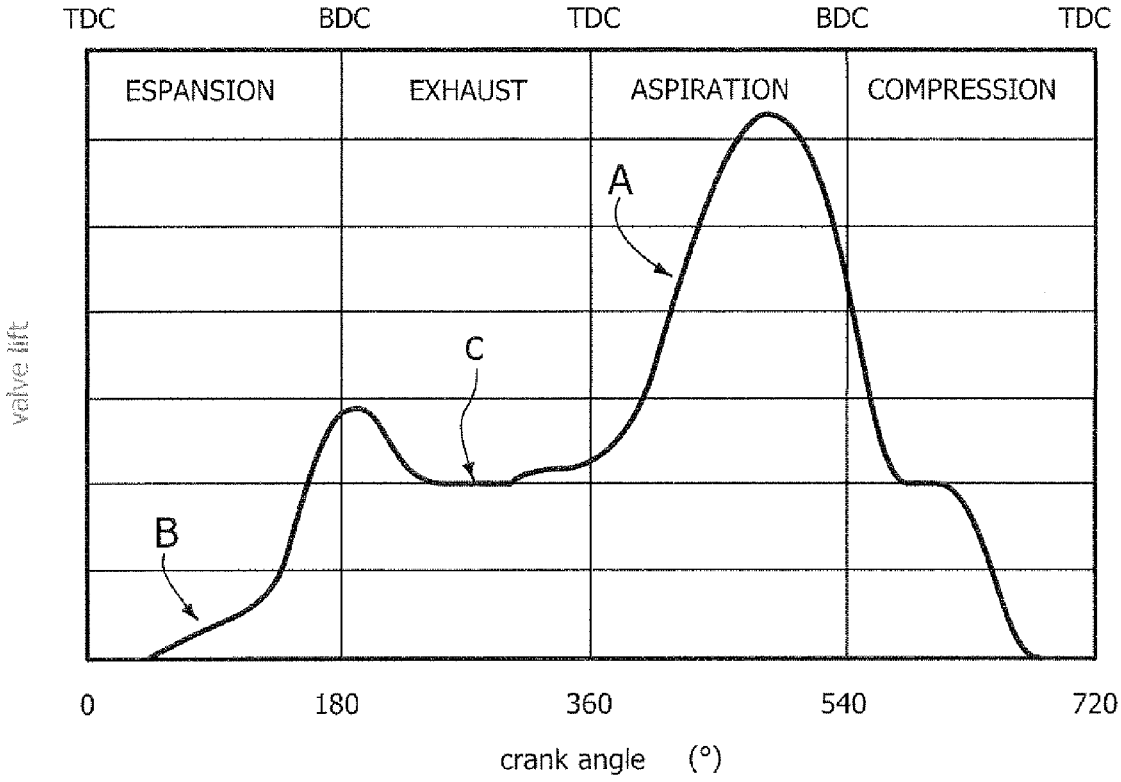

None of the solutions previously proposed envisaged, however, a conformation of the additional lobe 41 of the cam 9 for controlling intake of the type illustrated in FIG. 3 or FIG. 4 such as to give rise to a diagram B of the additional lift of the type illustrated in FIG. 4 or FIG. 6. As may be seen in said figures, said diagram is characterized by a boot conformation with an initial portion $B_I$ with gentler slope, which then extends into a second portion having the traditional bell shape, rising with a steeper slope, which terminates in a point M of maximum lift, and then descending. The initial portion $B_I$ of the profile of the additional lift of the intake valve extends from an initial point X of zero lift corresponding to a crank angle comprised in the expansion stroke in the cylinder.

Figure 5:
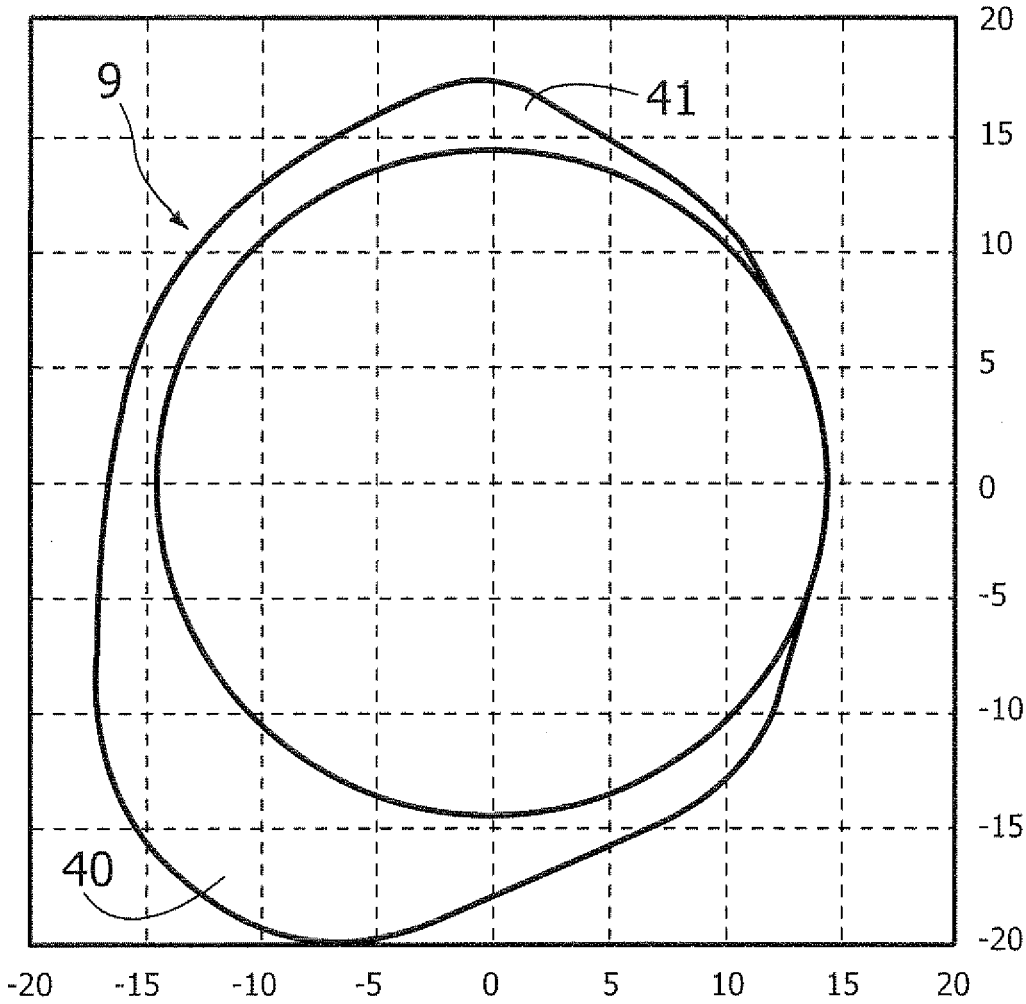
FIGS. 5 and 6 illustrate a variant of the solution of FIGS. 3 and 4, which corresponds to the teachings of the present invention.
Figure 7:
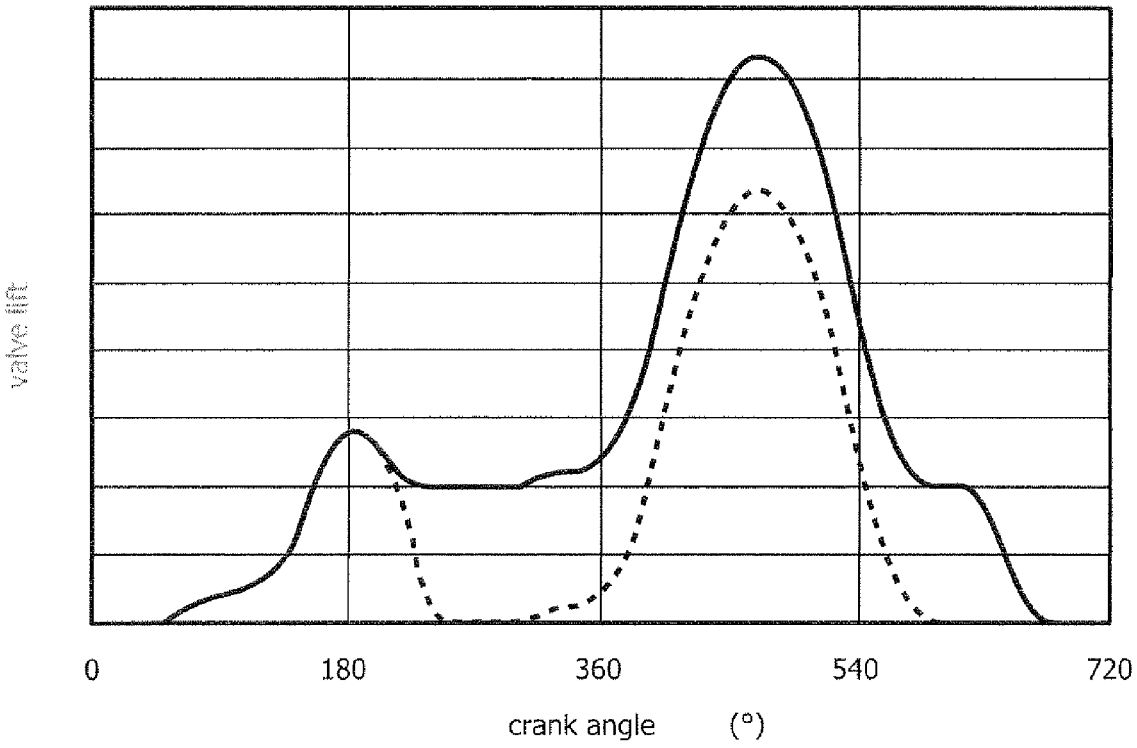
FIG. 7 is a profile that enables comparison between the diagrams of FIGS. 4 and 6.

FIGS. 5 and 6 illustrate a variant of FIGS. 3 and 4 that forms the subject of the present invention and differs from the solution described previously in that in this case the additional lobe 41 has a terminal portion radiused with the main lobe so as to provide a lift profile of the type illustrated in FIG. 6, in which a stretch C is envisaged with a non-zero and substantially constant lift between the end of the additional profile B and the start of the main profile A. The diagrams of valve lift of FIGS. 4 and 6 are directly compared with one another in the diagram of FIG. 7.

According to said variant, the tappet and the corresponding pumping piston do not return into the end-of-travel position after engagement on the additional lobe of the cam, before engaging the main lobe. This is done so that the chamber 6 will be emptied of less oil (FIG. 1) in the aforesaid phases (typically upon cold starting at temperatures of between −30° C. and −15° C.), where the additional lobe is rendered inactive. In this way, the pressurized chamber 6 manages to remain full of oil at the moment when the solenoid valve is closed to cause opening of the intake valve during the normal induction stroke, notwithstanding the short time that elapses between descent of the tappet from the additional lobe and ascent of the tappet on the main lobe.

Figure 1:
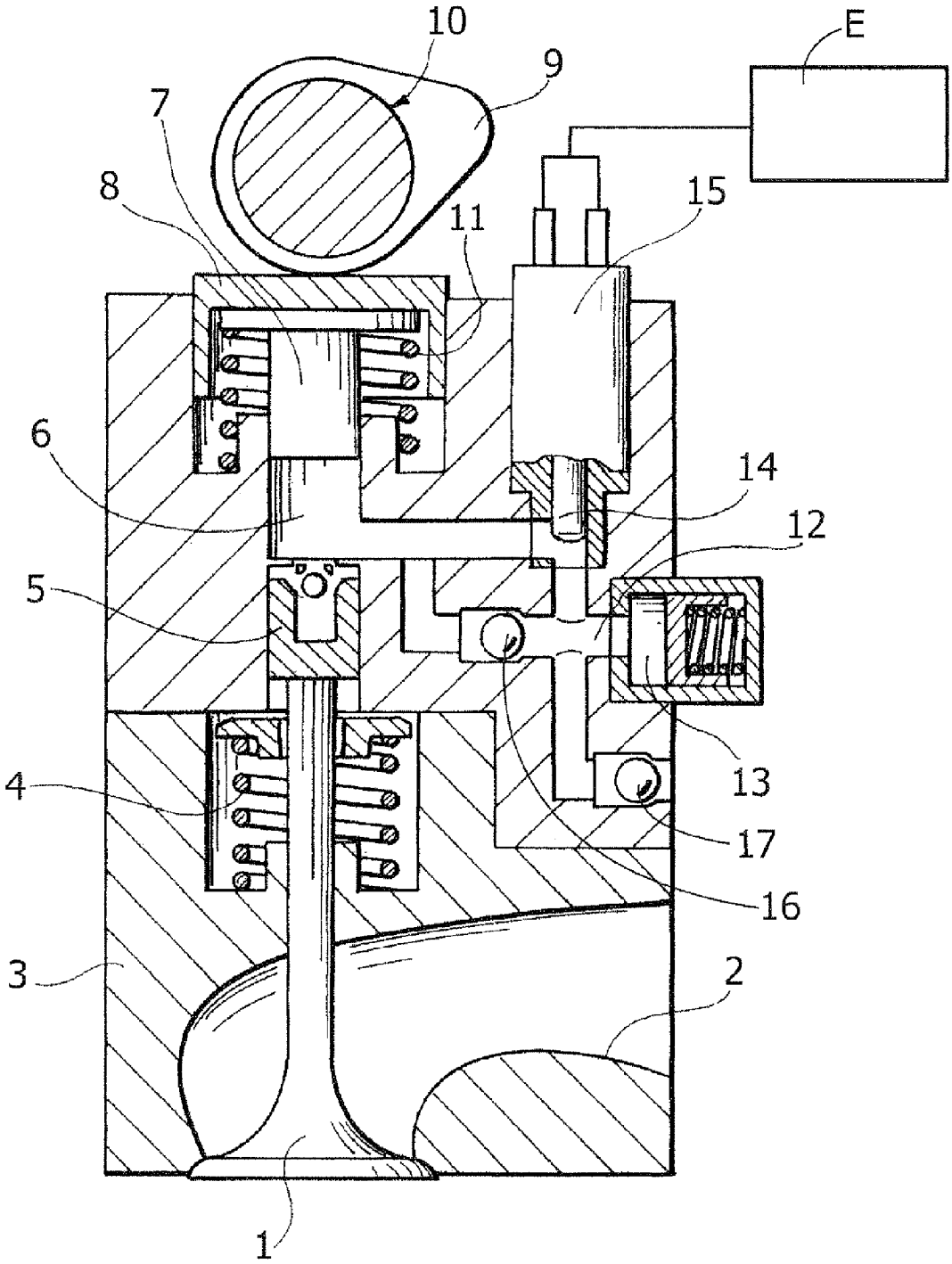
FIG. 1 is a schematic view exemplifying an electronically controlled hydraulic system for variable actuation of the intake valves, of the so-called UNIAIR type (in itself known), developed by the present applicant and used in the engine according to the invention.

The adoption of cams designed to generate the lift profiles visible in FIG. 4 or in FIG. 6, in combination with a diesel engine of the type illustrated in FIG. 2, and provided with a UNIAIR or MULTIAIR system of the type schematically illustrated in FIG. 1 moreover enables considerable advantages to be achieved in terms of reduction of noxious emissions and in particular of nitrogen oxides in the various running conditions of the engine at the various r.p.m.

The strategy of control of the engine according to the invention is described hereinafter for the various operating conditions.

Stationary Conditions with Engine Warm (Temperature of the Engine Coolant Equal to or Higher Than 90° C.)

In theory, in the stationary operating conditions with the engine warm it would be desirable to entrust the exhaust-gas recirculation exclusively to the external recirculation system, by means of the long-route duct 34. However, the mass flow-rate of the gases through said duct is somewhat limited by the reduced pressure jump available. The presence of the throttle 37 (FIG. 2), which is designed to reduce the pressure in situ, does not, however, enable, in these conditions, recirculation of the entire amount required. Consequently, in the stationary conditions with the engine warm, the exhaust-gas recirculation is actuated both by means of the long-route EGR through the duct 34, activating in a suitable way the valve 36, and by means of internal EGR obtained rendering the additional lobe 41 of each cam 9 active (by closing the solenoid valves 15). The internal EGR presents, however, the drawback that the gases recirculated therewith are very hot and consequently reduce the density of the charge in the combustion chamber, preventing the introduction of high rates of cold exhaust gases coming from the long-route EGR duct 34. The use of the internal EGR must hence be limited and is not adopted if the effective average pressure in the combustion chamber is higher than a threshold value, for example, in the region of 3 bar. In order to overcome said drawback, the solenoid valves 15 are controlled so as to render the profile B of the additional lift (FIG. 4) active with a certain delay, giving rise to a valve lift designated by B2, so as to reduce the amount of internal EGR.

According to the invention, the additional lobe 41 has a profile such that, albeit rendered active with a delay, determines a valve lift, designated by B2 in the diagram of FIG. 4, of an amount sufficient for compensating for the effects of reduction of the pressure jump between the combustion chamber and the intake duct and guaranteeing the recirculation required.

Transient Conditions with Engine Warm

In operating conditions where the engine is warm (temperature of the coolant at least equal to 90° C.) and in transient regimes, for example, when the accelerator is pressed after having been released completely (i.e., after a so-called "cut-off"), the system is controlled so as to assign the function of exhaust-gas recirculation entirely to the internal EGR, provided by means of the additional lobe 41 of the cam (which hence in said condition is rendered active by closing of the solenoid valves 15). In the aforesaid transient conditions, the long-route recirculation duct 34 is substantially without burnt gases so that it is not able to supply a ready response in terms of reduction of nitrogen oxides. Consequently, in said condition, the profile B of the additional lift is exploited fully by closing in said phase the solenoid valves 15.

Stationary Conditions with Engine Cold (Temperature of the Coolant Below 30° C.)

In stationary operating conditions with the engine cold, i.e., with the temperature of the engine coolant below 30° C., it becomes more important to control the emissions of carbon monoxide, unburnt hydrocarbons, and particulate, and the stability of combustion of the engine, rather than the production of nitrogen oxides, linked to very high combustion temperatures, which cannot take place. In any case, it is not advantageous to resort to the long-route external EGR (as has been described in FIG. 2; a recirculation circuit having a by-pass valve has, however, on the other hand, been mentioned on page 10, lines 3÷8: in these conditions also the long-route EGR could co-operate), in so far as the recirculated gases are cold and prevent a fast warm-up of the engine in order to reach the steady-state temperatures as soon as possible. In said condition, it is consequently more advantageous to use the hotter gases that can be recirculated via the internal EGR, rendering active, by closing the solenoid valves 15, the profile of additional lift B. In said condition, it is particularly advantageous to exploit the initial part $B_i$ with gentler slope of the boot profile B. It is in fact necessary to anticipate considerably opening of the intake valve (during the expansion stroke) to increase the temperature of the gases picked up.

It should be noted that the solution consisting in adopting the aforesaid radiusing profile C between the main profile A and the additional profile B could be adopted also in combination with a profile B of a different type from the one illustrated in FIG. 4. However, the profile B of FIG. 4 presents evident advantages and has also, taken in itself, formed the subject of a copending European patent application filed in the name of the present applicant.

Of course, without prejudice to the principle of the invention, the details of construction and the embodiments may vary widely with respect to what has been described and illustrated herein, without thereby departing from the scope of the present invention.

What is claimed is:

1. A diesel engine comprising:

at least one intake valve for each cylinder, provided with elastic return means that push the valve towards a closed position; and at least one camshaft for controlling the intake and exhaust valves, by means of respective tappets, wherein at least one intake valve for each cylinder is controlled by the respective tappet, against the action of the aforesaid elastic means, by interposition of hydraulic means including a pressurized fluid chamber, wherein said pressurized fluid chamber is designed to be connected by means of a passage controlled by a solenoid valve with an exhaust channel, so that when the solenoid valve is open, the intake valve is uncoupled from the respective tappet and is kept closed by said elastic means, there being associated to said engine electronic control means for controlling each solenoid valve in such a way as to vary the time and/or the stroke of opening of the respective intake valve as a function of the operating conditions of the engine, wherein the cam for controlling said intake valve has a main lobe for causing opening of the intake valve during the induction stroke for intake of fuel into the engine cylinder, and an additional lobe for causing an additional opening of the intake valve during the exhaust stroke, the additional lobe has a descending stretch radiused to the main lobe with a stretch corresponding to a non-zero lift of the valve, in such a way that the profile of the lift of the valve has a portion (C) corresponding to a substantially non-zero value of the lift that radiuses the descending stretch of the profile (B) of the additional lift to the ascending stretch of the profile (A) of the main lift, said portion (C) being an extended stretch corresponding a substantially constant lift through a substantial crank rotation between the end of the additional profile (B) and the start of the main profile (A).

2. The engine according to claim 1, wherein the additional lobe is shaped in such a way as to provide a profile of the additional lift of the intake valve, as the crank angle varies, which is shaped like a boot with an initial portion with gentler slope, which then extends into a second portion having the traditional bell shape, rising with a steeper slope, which terminates in a point of maximum lift, and then descending, said initial portion of the profile of the additional lift of the intake valve extending from an initial point (X) of zero lift corresponding to a crank angle comprised in the expansion stroke in the cylinder.

3. The engine according to claim 2, wherein it comprises a supercharging compressor and a duct for exhaust-gas recirculation that extends starting from a point downstream of a device for the treatment of the exhaust gases and converges into the intake duct upstream of the aforesaid compressor;

and said electronic control means for controlling the aforesaid solenoid valve associated to the intake valves of the engine are also pre-arranged for controlling a valve that controls the flow of the gas recirculated via the aforesaid recirculation duct.

* * * * *